United States Patent [19]

Maier

[11] Patent Number: 4,881,690

[45] Date of Patent: Nov. 21, 1989

[54] WASTE COMMINUTING APPARATUS

[75] Inventor: Henry C. Maier, Seaford, Australia

[73] Assignee: Liangtraco (Aust) Pty. Ltd., Victoria, Australia

[21] Appl. No.: 232,095

[22] Filed: Aug. 15, 1988

[30] Foreign Application Priority Data

Jan. 28, 1988 [AU] Australia ..... PI6494

[51] Int. Cl.[4] ..... B02C 7/04

[52] U.S. Cl. ..... 241/82.3; 241/82.5; 241/101 B; 241/101.7; 241/247; 241/261.1

[58] Field of Search ..... 241/186 R, 260.1, 101 B, 241/101.7, 245, 246, 247, 98, 261.1, 82.1, 82.3, 82.5, 84

[56] References Cited

U.S. PATENT DOCUMENTS

| | | | |
|---|---|---|---|
| 3,933,314 | 1/1976 | Luscombe | 241/186 R |
| 4,057,952 | 11/1977 | Brokaw | 241/186 R X |
| 4,408,725 | 10/1983 | Wenger et al. | 241/260.1 |
| 4,512,523 | 4/1985 | Higashimoto | 241/260.1 X |
| 4,638,954 | 1/1987 | Poss | 241/260.1 X |

*Primary Examiner*—5
*Assistant Examiner*—Timothy V. Eley
*Attorney, Agent, or Firm*—Nixon & Vanderhye

[57] ABSTRACT

An apparatus for comminuting grass clippings and other waste material comprising an elongate cylindrical barrel, an extrusion screw mounted for rotation within said barrel, an inlet opening at one end of the barrel through which material to be comminuted is presented to the extrustion screw by feeding means, an end cap closing the end of said barrel and having a shaped inner surface corresponding the shape of a generally conical end portion of said extrusion screw, said end cap having a plurality of openings through which the comminuted material is forced by said extrusion screw, said openings being directed towards the line of contact between the end of the flight of said extrusion screw and the end of said barrel.

12 Claims, 12 Drawing Sheets

WASTE COMMINUTING APPARATUS

FIELD OF THE INVENTION

This invention relates to comminuting apparatus, and more particularly to a comminuting apparatus suitable for reducing the volume of garden waste, such as grass clippings and leaves, and office waste, such as shredded paper.

BACKGROUND OF THE INVENTION

The disposal of grass clippings is a problem for both householders and for lawn mowing contractors. While grass clippings can be spread on a garden, it is difficult and time-consuming to spread properly and the clippings usually develop into thick beds which provide an ideal environment for the breeding of flies.

Most mowing contractors usually remove grass clippings and they must therefore make regular trips to disposal sites, usually once or twice a day. Lawn clippings are virtually impossible to compact by compression and accordingly contractors have little option but to make regular disposal trips. In Autumn, falling leaves compound the disposal problem for both gardeners and contractors.

In the office environment, waste paper, often in the form of shredded documents, create storage and disposal problems as a result of the space occupied by such materials. Again, waste paper is difficult to compress without a large compacting machine, and since such machines occupy further space, they are rarely used.

SUMMARY OF INVENTION AND OBJECTS

It is an object of the present invention to provide an apparatus which is capable of comminuting garden refuse, such as grass clippings and leaves, and other materials which create disposal problems, such as shredded paper, whereby the space occupied by such materials is substantially reduced and the problem of disposal of such materials significantly improved.

The invention provides a comminuting apparatus comprising an elongate cylindrical barrel, and extrusion screw mounted for rotation within said barrel, means for rotating said screw within said barrel, inlet opening means at one end of said barrel through which material to be comminuted may be presented to the extrusion screw, and means for closing the other end of said barrel having openings through which comminuted materials is forced by said extrusion screw.

Where the feed material is grass clippings, the extrusion screw reduces such clippings to a substantially finely divided or powdered form, which significantly reduces the volume occupied by the clippings, for example, of the order of 80–90%. In the finely divided form produced by the apparatus defined above, the comminuted clippings may be easily spread on a lawn or on a garden bed to serve as a mulching or fertilizing material. Since the clippings are finely divided or powdered, they do not build up into thick beds and the fly breeding problem referred to above is significantly reduced. Alternatively, the finely divided clippings may be disposed of by removal to a dumping site, but since the volume of the clippings is substantially reduced, less frequent disposal visits need be made by the gardener or contractor.

In a preferred form of the invention, the comminuting apparatus is mounted on a mowing machine and receives clippings directly from the cutting blades for processing. In this arrangement, the comminuted clippings are simply dropped onto the lawn as it is cut.

Leaves may be similarly comminuted by the apparatus defined above, and other garden refuse, such as cuttings, may also be comminuted, provided the cuttings are reduced to a suitable size, for example, by a mulching machine, before being fed into the apparatus.

Waste paper, such as shredded paper, maybe similarly reduced to finely divided or powdered form by the apparatus defined above, thereby significantly reducing the volume occupied by the waste material and reducing the number of rubbish collections required.

In a preferred form of the invention, the extrusion screw has a generally cone-shaped or frusto conical forward end, and the means closing the end of the barrel is formed with a similarly shaped internal surface. In a particularly preferred form, a space is created in the means closing the end of the barrel, into which partly comminuted material may be recirculated to ensure that it is more finely comminuted by the extrusion screw. To assist in this regard, the forward end of the extrusion screw is formed with a groove or blade-like means extending from the end of the flight of the extrusion screw to the tip of the cone-shaped forward end so that the material being comminuted is moved by the groove or blade towards the centre of the means closing the end of the barrel.

To further assist in the degree of comminution of the material, the extrusion openings formed in the means closing the end of the barrel are formed in only one half or less of the means closing the end of the barrel. While spaced openings formed in the whole of the end of the means closing the end of the barrel produce a material which is sufficiently comminuted to substantially reduce its volume, a powdered material is not produced unless only half or less of the end of the means closing the end of the barrel is formed with extrusion openings.

While the material to be comminuted may be manually fed into the inlet opening, such an arrangment is not particularly practical and it is preferred that the apparatus include a means for automatically feeding the material into the inlet opening.

In one preferred form, the feeding means comprises a hopper surrounding the inlet opening, said hopper supporting a pair of feeding rollers mounted adjacent the inlet opening, at least one of which rollers is rotatably driven to feed the material to be comminuted to the extrusion screw, said feeding apparatus preferably further comprising a multiplicity of feeding fingers positioned over said rollers and operating to push the material to be comminuted towards the feed rollers.

Alternatively, the feeding means may be in the form of an auger.

The inlet opening in the barrel may be formed in the side of the barrel so that the material to be comminuted is fed to the extrusion screw in a generally horizontal direction rather than a vertical direction.

BRIEF DESCRIPTION OF THE DRAWINGS:

One presently preferred form of the invention will now be described with reference to the accompanying drawings in which.

Figure 1:
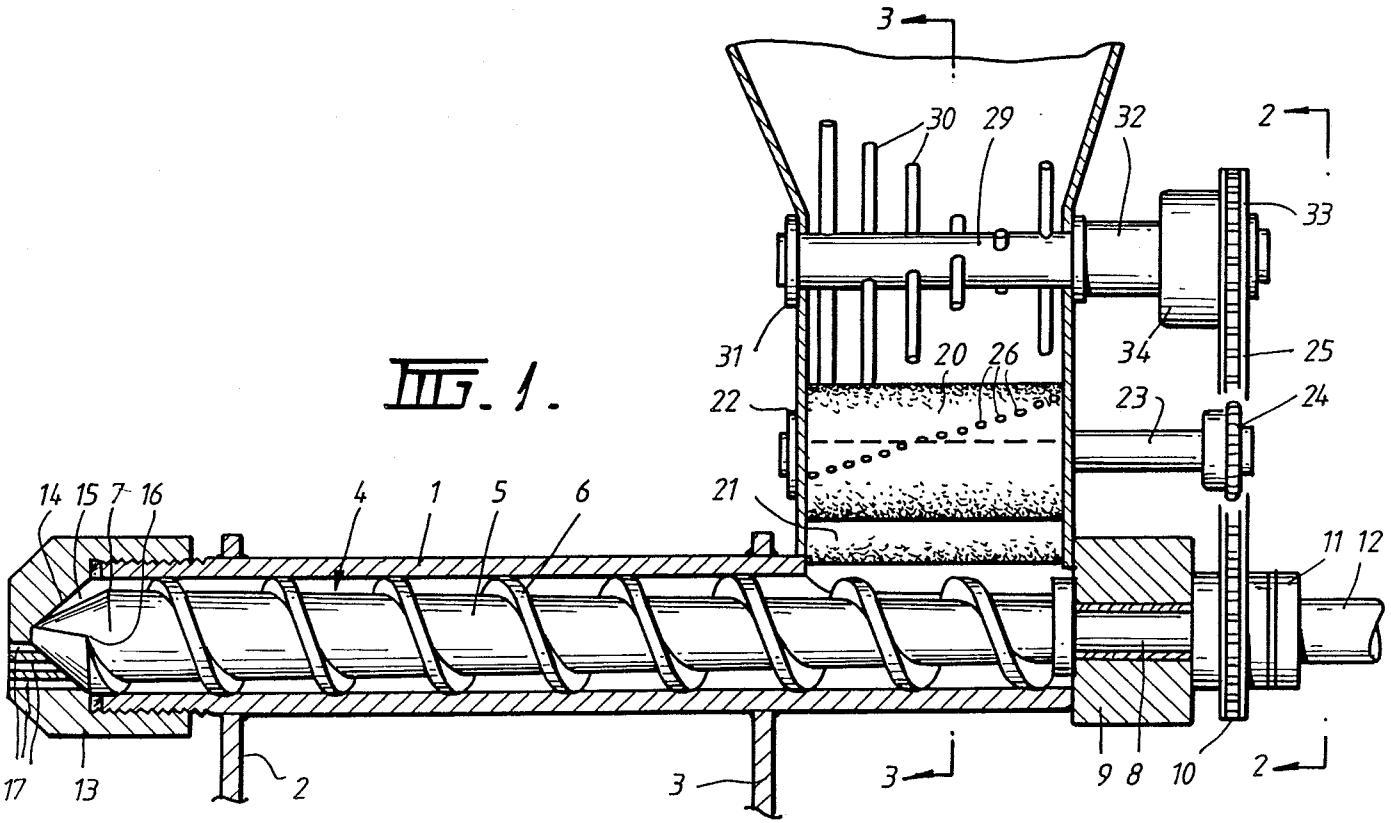
FIG. 1 is a sectional side elevation of a comminuting apparatus embodying the invention.
Figure 2:
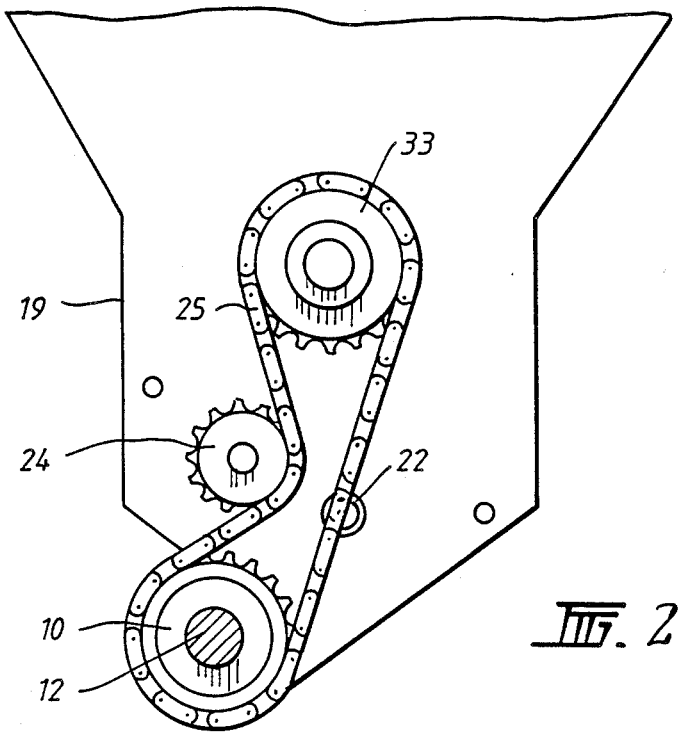
FIG. 2 is an end elevation taken along the line 2—2 in FIG. 1.
Figure 3:
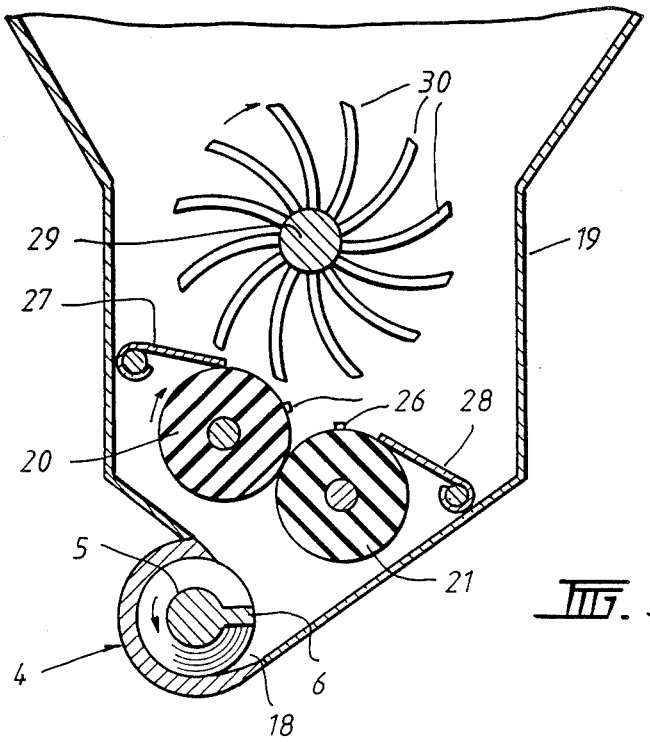
FIG. 3 is a sectional end elevation taken along the line 3—3 in FIG. 1.

DESCRIPTION OF PREFERRED EMBODIMENTS:

Referring to FIGS. 1 to 3 of the drawings, the comminuting apparatus embodying the invention will be seen to comprise an elongate cylindrical barrel 1 carried by a pair of supports 2, 3 attached to a supporting base (not shown), said barrel 1 carrying an extrusion screw 4 having a central shaft 5 of increasing diameter about which a helical flight 6 extends from one end of the shaft 5 to the other. The extrusion screw 4 terminates in a conical end portion 7 and has a drive shaft 8 extending from the other end supported by a bearing 9 and having a drive sprocket 10 incorporating a clutch 11 keyed thereto. The clutch 11 is driven by a drive shaft 12 which is in turn driven by an electric motor (not shown) or other source of drive.

The forward end of the barrel 1 is closed by a nozzle 13 which is threadably engaged with the end of the barrel 1 as shown. The internal surface of the nozzle 13 is conically shaped throughout part of its surface so that it conforms to the shape of the nose 7 of the extrusion screw 4, but is enlarged at the position 14 to create a space 15 within which the material to be comminuted may recirculate for further comminution by the nose 7 of the extrusion screw 4. To assist in this regard, the nose 7 of the extrusion screw 4 is formed with a shallow groove or blade 16 extending from the end of the flight 6 of the screw 4 to the tip of the conical nose 7. This groove 16 forces the material to be comminuted towards the centre of the nozzle 13 thereby ensuring that it is adequately comminuted before being ejected out of the extrusion openings 17 in the nozzle 13. The depth of the groove 16 is approximately the same as the depth of the flight 6 at the end of the flight 6 and tapers to virtually no depth at the end of the nose 7. To further improve the degree of comminution of the material, the extrusion openings 17 are formed in only one half of the end of the nozzle 13, as shown in FIG. 1 of the drawings.

As shown most clearly in FIG. 3 of the drawings, a material inlet opening 18 is formed in the side of the barrel 1 and a hopper 19 is fixed to the barrel around the opening 18. A pair of feed rollers 20, 21 are rotably mounted within the hopper immediately above the inlet opening 18, with the roller 20 at an elevated position with respect to the roller 21. The roller 20, 21 are mounted for rotation in bearings 22 carried by the walls of the hopper 19 and the roller 20 is rotatably driven by a shaft 23 carrying a sprocket 24 driven by a chain 25 engaging the sprocket 10, as shown most clearly in FIG. 2 of the drawings. It will be noted that the roller 20 rotates in a direction opposite to the extrusion screw 4.

The rollers 20 and 21 are each provided with a diagonal row of spaced short projections 26 in the form of bristles to assist in feeding the material to be comminuted between the rollers 20 and 21. The rollers 20 and 21 are spaced apart by a distance equal to the size of the smallest object which may pass through the extrusion screw 4 without damaging the screw or the barrel 1. In the present embodiment, the minimum flight depth of the screw is of the order of 6 to 7mm so the gap between the rollers 20 and 21 is set at that dimension.

A pair of hinged baffles 27, 28 are also mounted within the hopper so that they extend between the sides of the hopper and are positioned partially overlying each of the rollers 20 and 21. The baffles 27 and 28 prevent the passage of undesired material past the rollers 20 and 21. The baffles are pivotally mounted to enable access to the rollers 20 and 21 for cleaning and servicing purposes.

Immediately above the rollers 20 and 21, a shaft 29 carrying a multiplicity of radially extending resilient fingers 30 is rotatably mounted in bearings 31 carried by the walls of the hopper 19 and driven by a shaft 32 carrying a sprocket 33 mounted on a clutch 34, the sprocket being engaged by the chain 25 as shown. The fingers 30 operate to effectively "tease" the material to be comminuted and move it towards the rollers 20 and 21 for feeding to the extrusion screw 4. Since the ends of the fingers 30 are close to the roller 20 and are moving in an opposite direction to that roller, the fingers tend to flick stones and other undesired objects away from the roller onto the baffles 27 and 28.

The hopper may have any desired dimensions, but in the embodiment shown, which has been designed for comminuting grass clippings, the hopper 19 is preferably dimensioned to receive the contents of a typical grass catcher so that the clippings may be comminuted while further mowing is performed.

In the embodiment described above, the extrusion screw 4 is a modified extrusion screw from a plastics extrusion screw the principal modification being to the conical nose 7 by the formation of the groove 16. In the embodiment shown, the barrel is about 320 mm long, the screw 4 is about 40 mm in overall diameter, the helical flight 6 has a pitch of about 36 mm and the flight depth varies from about 30 mm at the inlet end to about 20 mm at the outlet end. The rollers presently in use are modified carpet beater rollers in which the bristles 26 are reduced in height. However, in a commercial embodiment of the invention, the rollers may in addition have a resilient sponge-like material applied to their surface to further assist in the feeding of the material to be comminuted.

In tests conducted using the apparatus described above, lawn mower cuttings were fed to the extrusion screw and were comminuted into a substantially fine powder form which was extruded through the extrusion opening 17 in the nozzle 13. This material was found to be easily distributed onto the lawn or onto a garden without creating the deep beds typical of unprocessed lawn clippings. The volume of the lawn clippings was found to be reduced by of the order of 80–90% thereby providing a significant advantage to a contractor who is required to remove the lawn clippings for disposal. If desired, a binder may be added to the clippings or directly introduced into the barrel so that the apparatus forms pellets of comminuted clippings for disposal or use as a fertilizer. Fertilizer additives may also be added to the material to be comminuted.

The apparatus may be used to similarly comminute other garden refuse as well as kitchen vegetable refuse and waste paper material in the form of shredded paper.

Referring now to FIGS. 4 to 10 of the drawings, an alternative embodiment of the invention is shown in which a comminuter 40, similar to the comminutěr described above, is mounted on a ride-on mower M from which the cut grass to be comminuted is conveyed to the comminuter via a flexible conduit C connected to the usual protective skirt S of the mower M. The comminuter 40 is mounted generally vertically on a back plate P of the mower M, to which a grass clippings receiving container is usually attached to receive grass clippings from the mower via the flexible conduit C. The comminuter 40 is driven from the main drive D of the mower M via a V belt 41 engaging a pulley 42 mounted on an idler shaft 43 supported by a bearing 44 secured to the plate P. The shaft 43 also supports a sprocket 45 engaged by a chain 46 engaging a sprocket 47 attached to the shaft 48 of the extrusion screw 49 of the comminuter 40.

Figure 8:
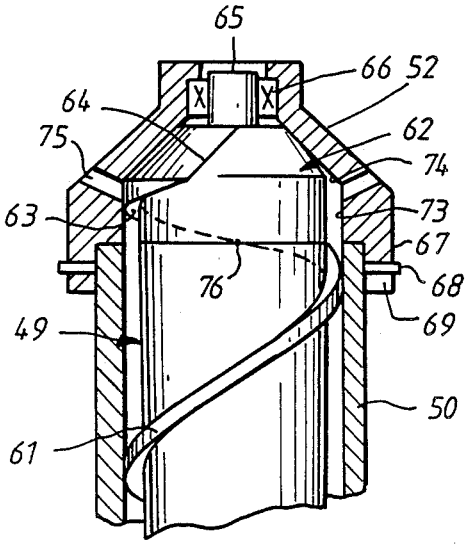
FIG. 8 is a fragmentary sectional view of the end of the comminuter.

In common with the previous embodiment, the comminuter 40 includes a cylindrical barrel 50 which is rigidly secured to the rear plate P of the mower M by means of securing saddles 51, said barrel 50 supporting the extrusion screw 49 for rotation within the barrel by means of bearings (only one of which is shown) at the lower end of the barrel and in the closing cap 52 for the barrel (see FIG. 8). The barrel 50 is formed with an inlet opening 53 over which is fitted a feeding tube 54 containing a feeding auger 55 driven by an electric motor 56 via a chain and sprocket drive arrangement 57.

Figures 4, 6:
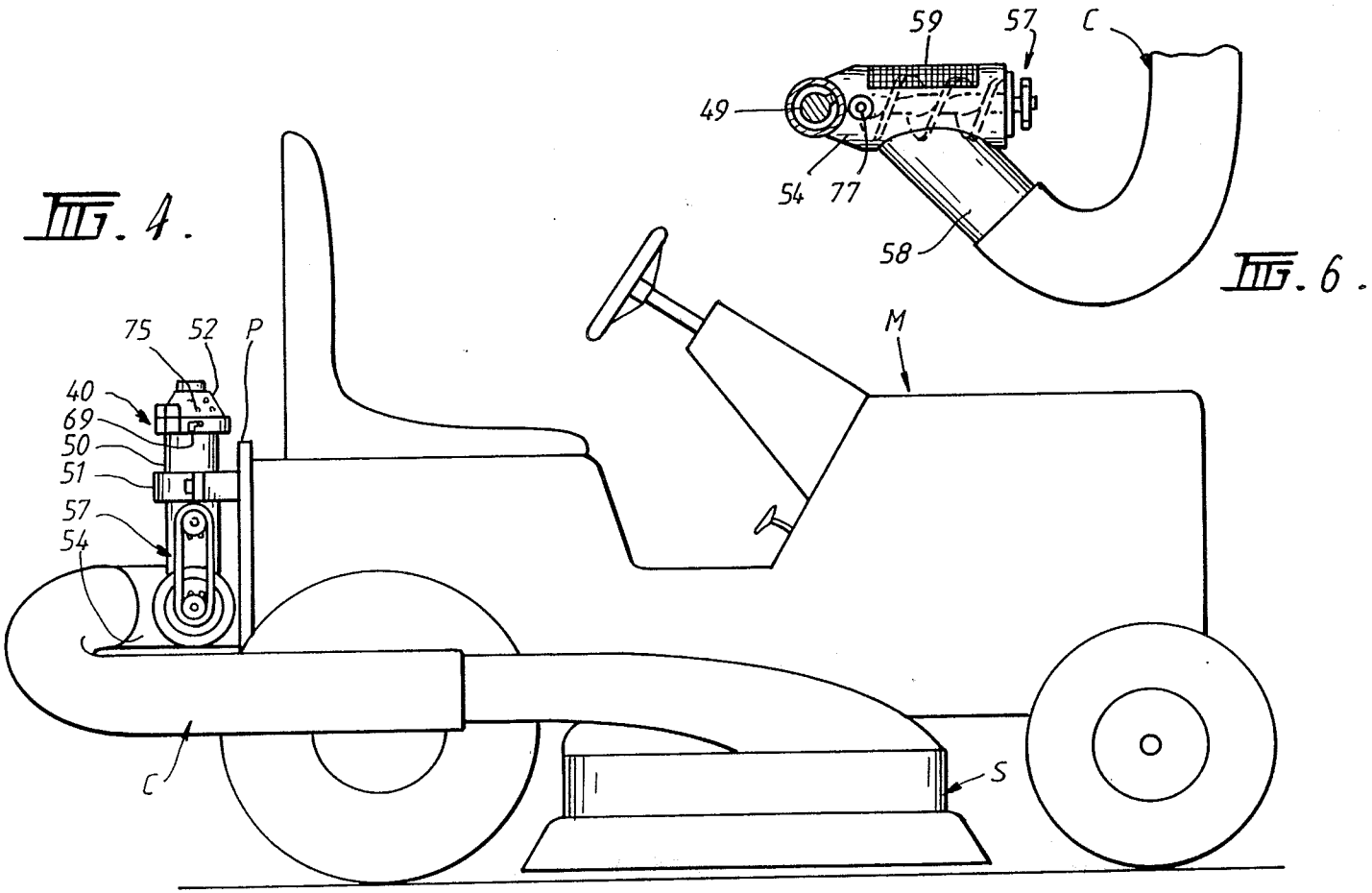
FIG. 4 is a side elevation of a side-on mower to which a modified comminution and feed mechanism has been fitted.
FIG. 6 is a fragmentary plan view of the feed mechanism to the comminuter.
Figure 5:
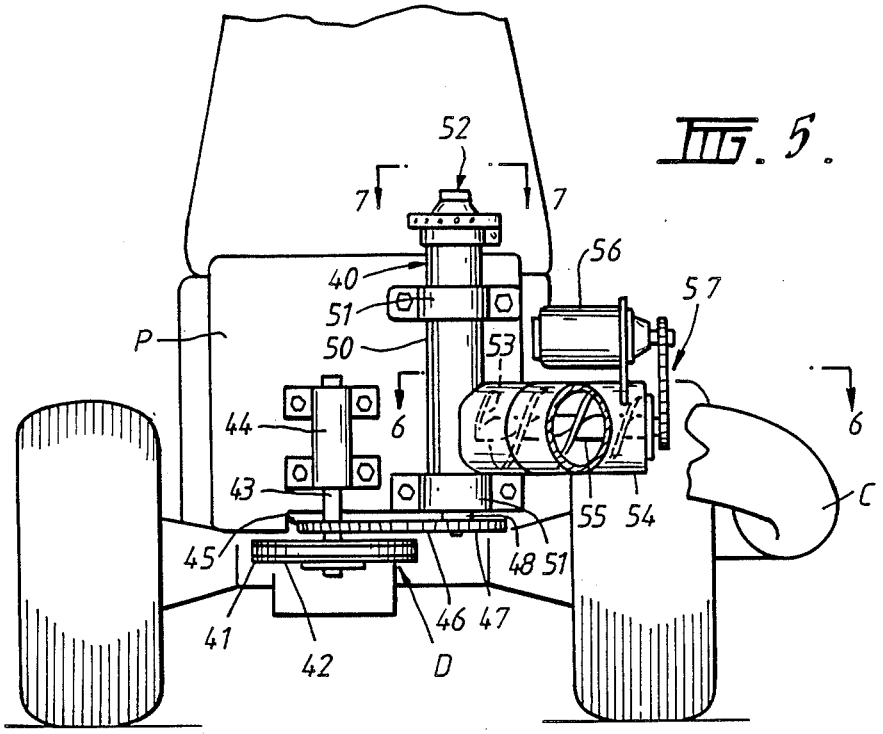
FIG. 5 is an end view of the mower of FIG. 4.

As will be seen most clearly from FIGS. 5 and 6 of the drawings, the feeding tube 54 includes an angularly arranged inlet tube 58 to which the conduit C is attached. Since in this arrangement the grass clippings are effectively blown into the feeding tube 54 under the action of the grass cutting blades of the mower M, a portion of the feeding tube 54 is defined by open mesh 59 to relieve the air pressure in the tube 54. Thus, the grass clippings are blown along the conduit C through the inlet tube 58 into the feeding tube 54 and the auger 55 is driven to force the grass clippings into the opening 53 of the barrel 50 so that the grass clippings are suitably fed into the extrusion screw 49. Although not shown clearly in the drawings, the auger 55 is supported for rotation within the tube 54 by means of a bearing plate 60 at the outer end of the feeding tube 54 and a bearing spider (not shown) at the inner end of the auger 55.

The extrusion screw 49 is similar to the extrusion screw 4 of the previous embodiment, although the dimensional parameters of the screw are slightly different. In the presently preferred form, the extrusion screw had an overall diameter of about 75 mm, a flight pitch of about 72 mm and flight depth which varies from 64 mm at the lower end of the screw to 49 mm at the upper end of the screw. The variation in flight depth may be achieved either gradually or in discrete steps, as in the case of the first embodiment. The extrusion screw 49 has a separate end portion 62 which includes an angular blade-like portion 64 extending from the end of flight 61 to the end of the extrusion screw 49.

A stub axle 65 extends from the end of the extrusion screw 49 and is supported by a bearing 66 mounted in the end closure 52 in the manner shown in FIG. 8 of the drawings.

The end closure 52 includes a flange portion 67 which engages the end of the barrel 50 and is held in position by pins 68 engaging slots 69, the shape of which will be most clearly seen from FIG. 4 of the drawings, to enable the end cap 52 to be removed and replaced. The end cap 52 is also provided with a gate member 70 (FIGS. 7 and 10) held in place by a pivot pin 71 and a closure bolt 72, which enable the gate member 70 to be swung out of the way to expose portion of the end 62 of the extrusion screw 49 in the event that a hard object such as a stone or a piece of wire is carried through the comminuter by the extrusion screw 49.

Figure 10:
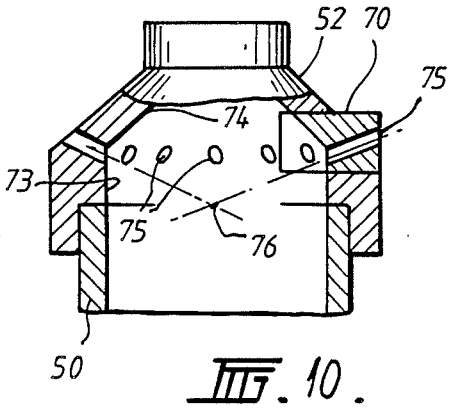
FIG. 10 is a fragmentary sectional elevation of the extrusion barrel and end fitting.
Figure 9:
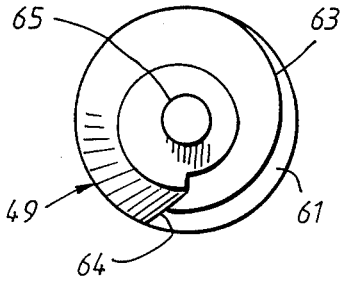
FIG. 9 is an end view of the extrusion screw.

The internal surface of the end cap 52 has the shape of a frustrum of a smooth curve corresponding in shape to the working portion of the end 62. A multiplicity of exit passages 75 are formed in the end cap 52 and extend angularly towards the line of intersection 76 between the end of the flight 61 and the end of the barrel 50. This is the point of maximum pressure between the extrusion screw 49 and the grass or other material being comminuted in the barrel 50 and the exit passages 75 should therefore lead towards and open through the cap 52. It will be noted from FIG. 7 that the openings 75 are formed in two rows: a lower row in which the openings extend to the line 76, as shown in FIG. 8, and an upper row in which the openings are directed towards the line 76 but open through the cap 52 at a higher position (FIG. 10). While the embodiment shown in FIGS. 7, 8 and 10 has a multiplicity of exit passages 75 extending about primarily one half the end cap 52, they may be replaced by two larger exit passages arranged at diametrically opposed positions of the end cap 52 but still leading towards the line 76.

As in the case of the previous embodiment, grass clippings are carried through the barrel 50 by the extrusion screw 49 and are increasingly comminuted by the action of the flight 61 against the inner surface of the barrel 50. Grass clippings which are not completely comminuted by the time they reach the line 76 are carried forwardly and are returned to the pressure line 76 by the blade member 64. In common with the first embodiment, a space (not shown), but similar to space 15 in FIG. 1 is provided between the cap 52 and the end portion 62 for this purpose and this space is primarily confined to the half of the cap 52 having fewer extrusion passages 75.

The completely comminuted grass clippings are extruded through the outlet passages 75 in a virtually powdered form. For this reason, the comminuted grass clippings may be allowed to drop back onto the lawn being mowed since they will act as a fertilizer for the remaining grass without producing the usual thatch produced by the uncollected lawn clippings.

In the event that the grass being mowed is dry, water may be added to the clippings in the tube 54 via a drip feed opening 77 (FIG. 6).

Figure 12:
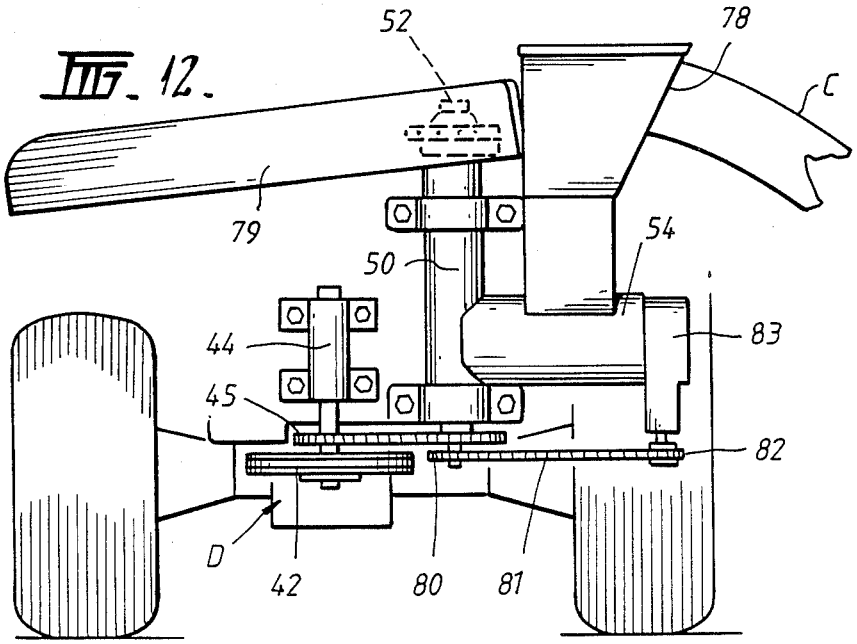
FIG. 12 is an end view of a modified feed mechanism.
Figure 7:
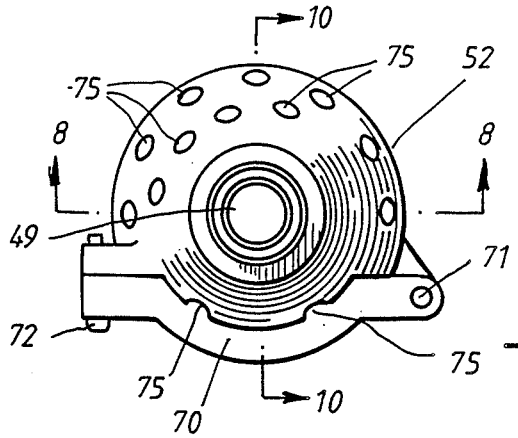
FIG. 7 is an end view of the comminuter shown in FIGS. 4 and 5.
Figure 11:
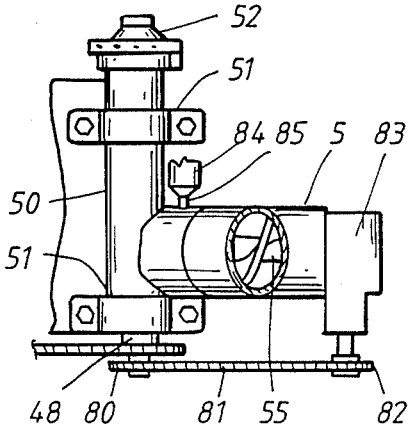
FIG. 11 is a fragmentary elevation of an alternative feed drive mechanism.

In the modification shown in FIGS. 11 and 12 of the drawing, grass clippings are first collected in a hopper 78 which opens into the feeding tube 54 containing the auger 55 (not visible) and the comminuted grass clippings coming from the passages 75 is first collected by a chute 79 so that it drops to the ground at a position which does not cause fouling of the drive train and other components of the device. Drive to the feeding auger 55 is in this case taken from a sprocket 80 attached to the end of the shaft 48 of the extrusion screw 49, via a drive chain 81 to a spocket 82 attached to the input shaft of a right-angled drive gear box 83 secured to the end of the feeding tube 54. In this embodiment, the grass clippings being fed by the auger 55 are moistened by means of a water supply bottle 84 connected to a drip feed outlet 85 similar to the drip feed 77 of the previous embodiment. Of course, any other suitable means for moistening the clippings being fed to the extrusion screw may be used.

In the embodiments of FIGS. 5 to 12 of the drawings, the extrusion screw is driven at approximately 200 rpm while the feeding auger is driven at approximately 350 rpm to achieve acceptable feeding speeds to the extrusion screw. It will be appreciated that the speed of drive will depend on the material being comminuted, the rate at which the material is fed to the extrusion screw and on other factors such as the moisture of the material being comminuted. If necessary, the drive speeds may be made more readily variable by the installation of suitable gear boxes.

It will be appreciated from the above description that the further embodiments of the invention provide a particularly convenient means of disposing of troublesome grass clippings in a manner which provides benefit to the grass being cut without the usual problems associated with non-collection of the grass clippings. The clippings are reduced by the comminuting device 40 to essentially a powdered form which is not at all unsightly if allowed to fall to the grass being cut and which decomposes far more rapidly than intact clippings to provide a desirable fertilizing effect.

I claim:

1. A comminuting apparatus comprising an elongate cylindrical barrel, an extrusion screw mounted for rotation within said barrel, means for rotating said screw within said barrel, inlet opening means at one end of said barrel through which material to be comminuted may be presented to the extrusion screw, and means for closing the other end of said barrel having openings through which comminuted material is forced by said extrusion screw, said extrusion screw having a generally helical flight extending from one end of the screw to the other and having a substantially constant pitch and a flight depth which reduces towards the closed end of the barrel whereby the material to be comminuted is increasingly compressed and comminuted, said extrusion screw also having a shaped end portion housed within said closed end of said barrel, said shaped end portion and said closed end of said barrel being shaped to provide a space therebetween; and recirculation means for recirculating partly comminuted material into said space, said recirculating means comprising edge means formed in said end portion of said extrusion screw at an acute angle to the longitudinal axis of said screw.

2. The comminuting apparatus of claim 1, wherein said end portion is generally cone-shaped.

3. The comminuting apparatus of claim 1, wherein said end portion is generally frusto conical.

4. The communiting apparatus of claim 1, further comprising means for automatically feeding the material to be comminuted into said inlet opening.

5. The comminuting apparatus of claim 4, wherein said feeding means comprises a hopper surrounding the inlet opening, said hopper supporting a pair of feeding rollers mounted adjacent the inlet opening, at least one of which rollers is rotatably driven to feed the material to be comminuted to the extrusion screw.

6. The comminuting apparatus of claim 5, further comprising a multiplicity of feeding fingers positioned over said rollers and operating to push the material to be comminuted towards said feed roller.

7. The comminuting apparatus of claim 4, wherein said feeding means comprises an auger arranged within a feeding tube which communicates with said inlet opening, said auger being driven at a speed which exceeds the speed of said extrusion screw.

8. The comminuting apparatus of claim 1, wherein said openings in said closing means are arranged to be aligned with line of contact between the end of said barrel and the end of the flight of said extrusion screw, said edge means extending at said acute angle from said end of said flight.

9. The comminuting apparatus of claim 1 wherein the majority of said openings in said closing means are formed in one half of said closing means, said space being primarily confined to the other half of said closing means.

10. The comminuting apparatus of claim 1 further comprising a removable section in said barrel by means of which access to said screw may be obtained to allow clearance of foreign matter.

11. A grass mowing machine having grass collection means and comminuting apparatus mounted on the machine such that grass clippings may be fed to the comminuting apparatus, said apparatus comprising an elongate cylindrical barrel, an extrusion screw mounted for rotation within said barrel, means for rotating said screw within said barrel, inlet opening means at one end of said barrel through which grass clippings to be comminuted may be presented to the extrusion screw, and means for closing the other end of said barrel having openings through which comminuted material is forced by said extrusion screw, said extrusion screw having a generally helical flight extending from one end of the screw to the other and having a substantially constant pitch and a flight depth which reduces towards the closed end of the barrel whereby the material to be comminuted is increasingly compressed and comminuted, said extrusion screw also having a shaped end portion housed within said closed end of said barrel, said shaped end portion and said closed end of said barrel being shaped to provide a space therebetween; and recirculation means for recirculating partly comminuted material into said space, said recirulating means comprising edge means formed in said end portion of said extrusion screw at an acute angle to the longitudinal axis of said screw.

12. The comminuting apparatus of claim 11, further comprising means for moistening the grass clippings as they are fed towards the extrusion screw.

* * * * *